US006220619B1

(12) United States Patent
Bardin et al.

(10) Patent No.: US 6,220,619 B1
(45) Date of Patent: Apr. 24, 2001

(54) DEVICE FOR HOLDING A BOOT ON A GLIDING BOARD, IN PARTICULAR A SKI

(75) Inventors: Roland Bardin, Varennes Vauzelles; Florence Mandon, La Murette, both of (FR)

(73) Assignee: Skis Rossignol S.A., Voiron (FR)

( * ) Notice: Subject to any disclaimer, the term of this patent is extended or adjusted under 35 U.S.C. 154(b) by 0 days.

(21) Appl. No.: 09/165,910

(22) Filed: Oct. 2, 1998

(30) Foreign Application Priority Data

Oct. 6, 1997 (FR) ..... 97 12636

(51) Int. Cl.[7] ..... A63C 9/24
(52) U.S. Cl. ..... 280/633; 280/634
(58) Field of Search ..... 280/11.3, 11.31, 280/11.33, 617, 618, 623, 625, 632, 633, 634

(56) References Cited

U.S. PATENT DOCUMENTS

| | | | | |
|---|---|---|---|---|
| 3,975,033 | * | 8/1976 | Lill et al. | 280/633 |
| 4,157,193 | * | 6/1979 | Beyl | 280/633 |
| 4,524,990 | * | 6/1985 | Syoboda et al. | 280/633 |
| 4,589,674 | * | 5/1986 | Krob et al. | 280/633 |
| 5,044,654 | * | 9/1991 | Meyer | 280/618 |
| 5,209,516 | * | 5/1993 | Arduin et al. | 280/633 |
| 5,318,321 | * | 6/1994 | Dogat et al. | 280/633 |
| 5,628,526 | * | 5/1997 | Zotter et al. | 280/633 |
| 5,813,690 | * | 9/1998 | Dogat | 280/633 |
| 5,913,532 | * | 6/1999 | Viodet et al. | 280/633 |

FOREIGN PATENT DOCUMENTS

| | | | | |
|---|---|---|---|---|
| 276180 | * | 2/1969 | (AT) | 280/633 |
| 3122468 | * | 4/1982 | (DE) | 280/633 |
| 3924939 | * | 5/1990 | (DE) | 280/633 |

OTHER PUBLICATIONS

Copy of French Search Report listing references.

* cited by examiner

*Primary Examiner*—Frank Vanaman
(74) *Attorney, Agent, or Firm*—Pitney, Hardin, Kipp & Szuch, LLP

(57) ABSTRACT

Holding device comprising a body (1) mounted so as to slide in a rail (4) on which it is maintained in position by means of a lock (9) that is articulated to the body (1) and is provided with an unlocking lever (20). This unlocking lever is provided with two lateral flanges (21, 22) extending toward the rail, on each side of the central region of the latter. The flanges (21, 22) are preferably divergent and their rear edge (23) is inclined.

This form of unlocking lever secures the lock against accidental unlocking in the event of impact.

4 Claims, 3 Drawing Sheets

DEVICE FOR HOLDING A BOOT ON A GLIDING BOARD, IN PARTICULAR A SKI

FIELD OF THE INVENTION

The present invention relates to a device for holding a boot on a gliding board, for example a ski, comprising a body which is mounted so as to slide on a rail, a lock which is articulated to said body and immobilizes this body on the rail, the lock and the rail being, for this purpose, provided with mutual attachment means along the central region of the rail, which means consist, on the one hand, of teeth and, on the other hand, of recesses in which the teeth are engaged, the lock being provided with an unlocking lever extending above the rail, in the direction of the outside of the body, this lever making it possible to manually release the lock from the rail by engaging a finger under the lever.

PRIOR ART

A device of this type is known from German utility model 295 20 845. The teeth of the lock engage in a rack on the rail, and the lever of the lock extends substantially above the rail so as to make it possible to disengage the lock from the rack by lifting the lever without the aid of a tool. The lever extends between two parallel side walls of the body, which are intended to protect the lock against unintentional unlocking due to an impact on its lever, for example the impact when the skis are loaded on a gondola lift. Safety of the lock therefore requires a particular binding body.

Another device of the same type is disclosed by French patent 2 735 699. In this device, the teeth of the lock engage in holes formed in a raised central zone of the rail, and the lever of the lock is provided with a T-shaped operating component fitted to it. This operating component may advantageously be actuated by putting two fingers under the bar of the T and pressing with the thumb on the body of the binding or the boot release lever, but it is exposed to impacts and therefore runs the risk of unlocking accidentally.

SUMMARY OF THE INVENTION

The object of the present invention is to provide a lock which has its own safety means so that it can be used in existing binding bodies.

To this end, the holding device according to the invention is one wherein said lever is provided with two lateral flanges extending downward, as far as the rail, on each side of the central region of the rail.

The unlocking lever may be a separate part from the lock, or may be integral with the lock.

Seen from the rear, the unlocking lever therefore has an inverted-U profile forming a recess in which a finger can be placed with ease in order to lift the lever, this profile being, however, narrow enough to prevent unintentional unlocking. The protective effect may further be enhanced by inclining the lateral faces of the unlocking lever and the outer edge of the flanges of the profile. This type of inclination has the advantage that, in the event of an impact, forces are generated that tend to press the lock against the rail.

In view of the dimensional tolerances which are accepted in the manufacture of ski binding components and are needed for manufacture at a reasonable cost, the lock will inevitably have some degree of play in the rail. In downhill skiing, this play will result in slight displacements, accompanied by noise, which may create a feeling of instability. The lock according to the invention makes it possible to reduce or even eliminate this play. To be precise, if the unlocking lever is integral with the lock, or if it is mounted without play on the lock, and if it is assumed that the transverse play between the flanges of the lever of the lock and the rail is equal to or less than the play involved in their mutual attachment, the lateral flanges of the unlocking lever being located at a distance from the zone where the lock is attached to the rail, in the longitudinal direction of the rail, they have the effect of substantially reducing or even eliminating the play in the mutual attachment. This can be demonstrated geometrically by means of two right-angled triangles in which the vertex lying at the lower end of the hypotenuse coincides with the articulation of the lock, and the short side opposite this vertex represents the play which is assumed to be the same for the attachment and for the flanges. If this short side is moved away from the opposite vertex, it is seen that the play in the attachment of the lock is greatly reduced. This play may even be eliminated completely by using a rail which has a raised central region and by giving the flanges of the lever of the lock an inclination such that the flanges diverge and bear against the sides of the raised region of the rail. In practise, as a result of stamping, the profile of the raised region of the rail will be trapezoidal.

According to another embodiment, the rail has two longitudinal grooves placed on each side of the central region, and the flanges of the lever of the lock are parallel and engaged in said grooves, the width of the grooves being substantially equal to the thickness of the flanges of the lock.

In this case, play is inevitable for the flanges in the grooves, but as explained above, this play, of the same order as the play in the attachment, has the effect of reducing the play in the attachment.

According to a preferred embodiment of the invention, the articulation of the lock in the body of the holding device is provided by two lateral tabs of the lock, by which the lock is held and articulated on the body.

According to a preferred embodiment of the invention, in which the holding device comprises a return spring bearing on an upwardly bent end of the lock, this bent end itself has a bend approximately halfway up so that the return spring bears essentially against a face inclined toward the lever of the lock so as to create a couple pressing the lock against the rail in the attachment zone.

BRIEF DESCRIPTION OF THE DRAWINGS

The appended drawing represents an embodiment of the invention by way of example.

DESCRIPTION OF THE PREFERRED EMBODIMENT

Figure 1:
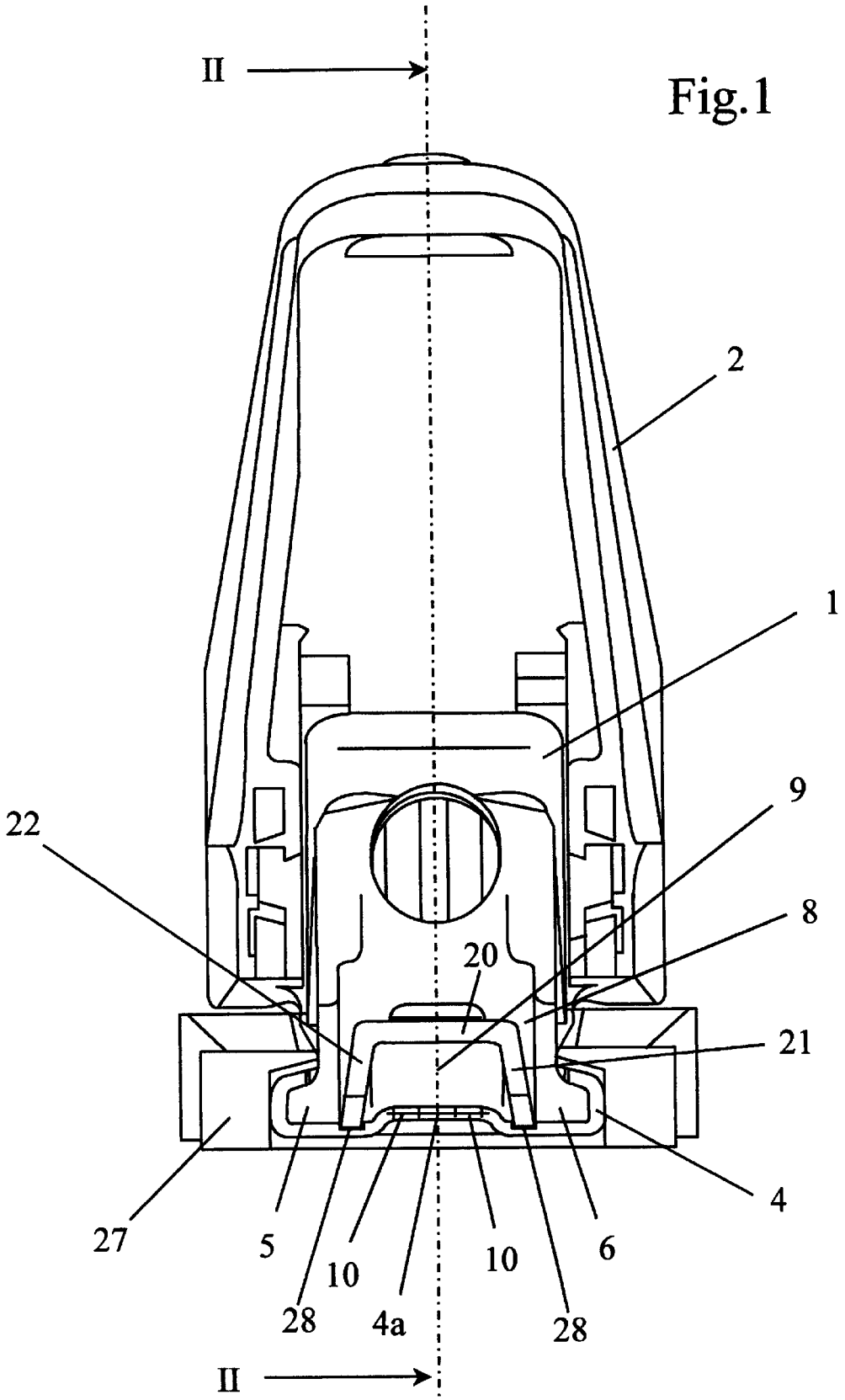
FIG. 1 is a rear end view of a heel binding long for a boot, or heel piece.

Since, with the exception of the lock, the heel piece that is represented is of a well-known type, it will not be described in detail.

The heel piece represented essentially consists of a binding body 1 and a heel grip 2 which is articulated about a pin 3 to the body 1 and is acted upon by a release spring contained in the body 1.

In order to be longitudinally adjustable, the body 1 is mounted on a rail 4 which consists of a metal profile with inwardly curved edges and in which the body 1 is engaged by two heels 5 and 6. The rail 4 is fastened by means of screws to the ski or to a raised platform. It is enclosed by a plastic covering 27. In its central part, the rail 4 has a raised band 4*a* in which two rows of holes 7 are formed. This band naturally has a trapezoidal profile due to stamping. Above the rail 4, the body 1 has a tunnel-shaped cavity 8 which accommodates a lock 9, provided with teeth 10 engaging in some of the holes 7, and a return spring 11 working in compression between the end wall 12 of the cavity 8 and the lock 9.

Figure 2:
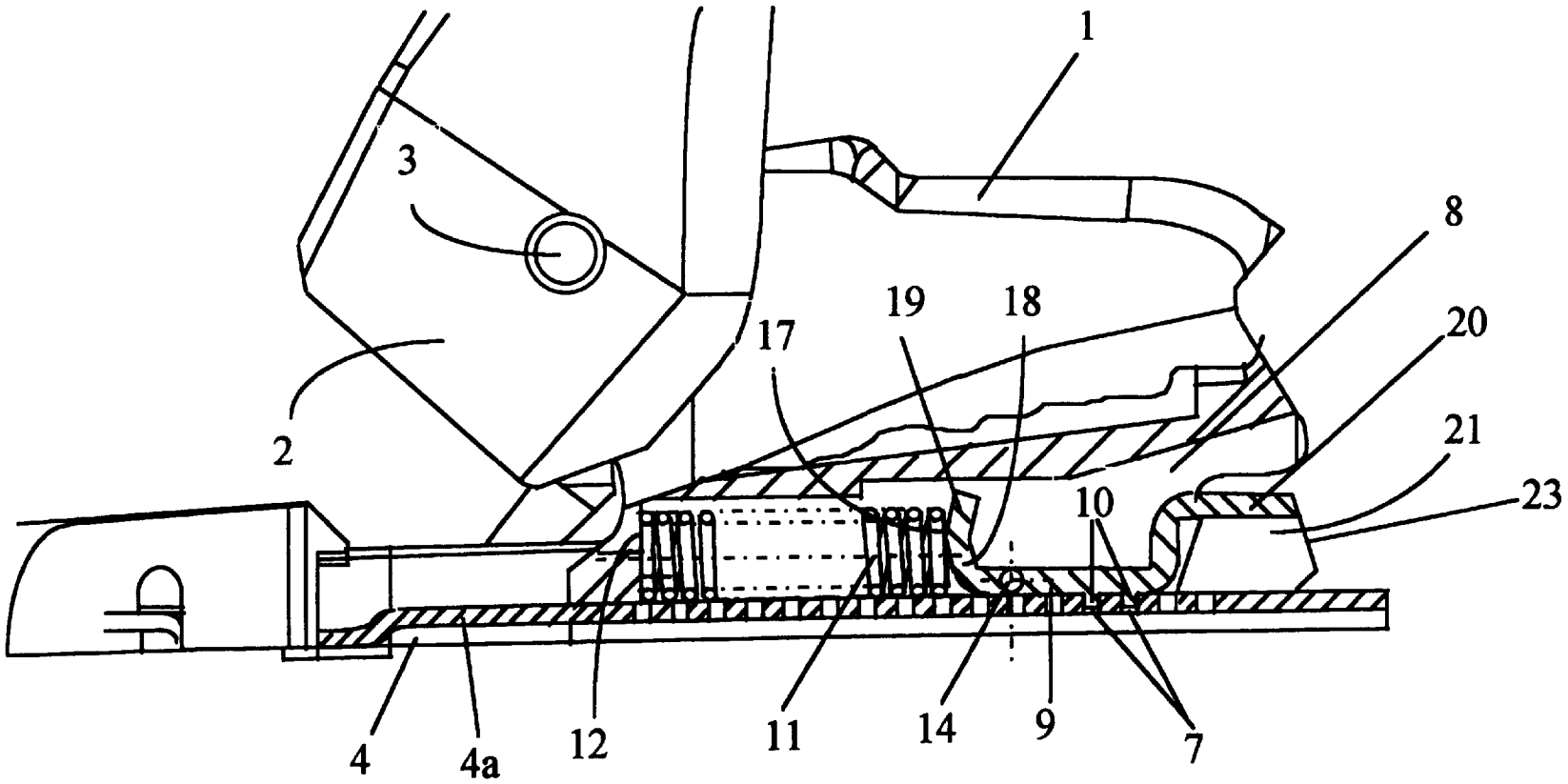
FIG. 2 is a view in axial section on II—II in FIG. 1, that is to say in the plan of symmetry.
Figure 3:
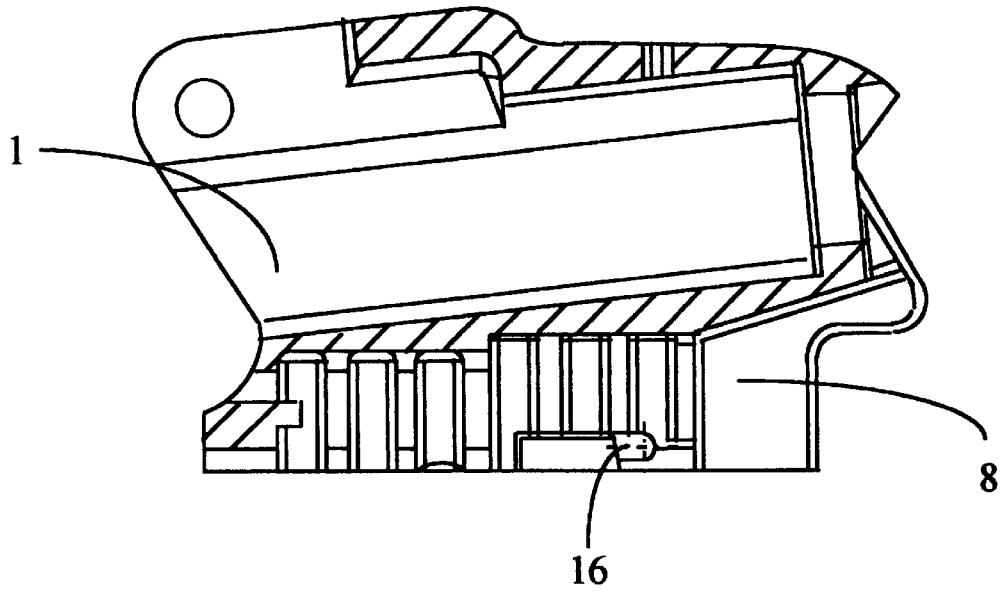
FIG. 3 is a view in section on II—II of the body of the binding on its own, that is to say without any other component of the heel piece.
Figure 4:
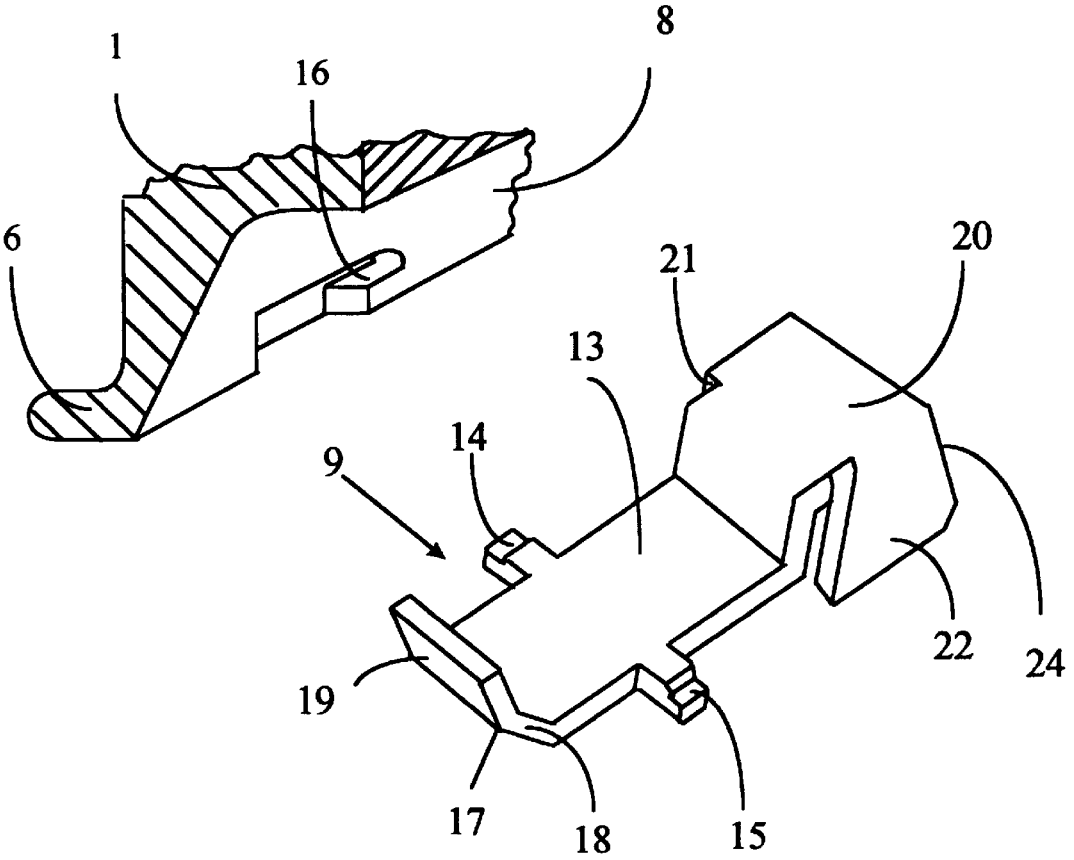
FIG. 4 is a partial perspective view of the body of the heel piece and the lock, illustrating the articulation of the lock to the body.

The shape of the lock 9 is clearly visible in FIG. 4. It consists of a stamped metal piece having a plane base 13, under which the teeth 10 are formed and which has two lateral tabs 14 and 15 used for articulating the lock 9 in the body 1. To this end, in the inner lateral faces of the cavity 8, the body 1 has attachment grooves 16, in which the tabs 14 and 15 engage and whose end surface serves as a support for the tabs 14 and 15. On the side facing the spring 11, the lock 9 has an upwardly bent part. This bent part itself has a bend 17, so that the bent part forms a dihedral angle 18, 19 which is substantially symmetrical relative to a horizontal plane and whose edge lies slightly above the axis of the spring 11, so that this spring bears on the bend 17 in order to create, around the articulation axis of the lock 9, a couple which tends to turn the lock 9 clockwise, FIG. 2, that is to say to press its toothed part against the rail 4 and consequently keep the lock in the locked position.

Toward the rear of the heel piece, that is to say toward the outside of the body 1, the lever 9 has a raised part 20 which extends above the rail and forms a lever for releasing the teeth 10 from their recesses 7. This lever 20 is provided with two lateral flanges 21 and 22 which extend downward, parallel to the longitudinal axis of the rail. These flanges 21, 22 are slightly inclined outwards so that the lever 20 and its flanges 21 and 22 form a trapezoidal profile which is clearly visible in FIG. 1. The distance between the flanges 21 and 22 at their root is less than the width of the raised central part 4*a* of the rail 4, while the distance between the flanges 21 and 22 at their ends is slightly greater than the width of the upper face of the central zone 4*a*. It can further be seen that the flanges 21 and 22 are at a distance from the teeth 10, that is to say from the zone where the lock attaches to the rail.

Under the effect of the thrust exerted by the spring 11, not only is the toothed part of the lock 9 pressed against the rail 4, but the flanges 21 and 22 of the lever 20 bear on the inclined sides of the raised central zone 4*a* of the rail 4, so that the lever 20 is applied without lateral play onto the rail 4.

Further, the outer edge (relative to the body 1, 23, 24) of the flanges 21 and 22 is inclined upward toward the teeth 10, that is to say the attachment zones, so that an impact on these edges, for example as a result of catching the edge of a ski or when loading on a gondola lift, does not entail the risk of lifting the lever 20 and consequently unlocking the lock 9, but instead will tend to press the lock against the rail.

If the lateral faces of the raised zone 4*a* of the rail were perpendicular to the plane of the rail, the flanges 21 and 22 would bear on the ridges formed by the edges of the raised zone.

The rail 4 could be without a raised central zone. In this case, it is expedient to provide two longitudinal grooves 28 extending on each side of the perforated or toothed central zone and the flanges 21 and 22, which could be parallel and whose thickness would be substantially equal to the width of the grooves, would engage in these grooves with a play inherently due to the manufacturing tolerances. If this play is of the same order as the play of the teeth 10 in the hole 7, the play of the lock in the rail is reduced for the geometrical reasons set out above.

The flanges 21 and 22 also have the effect of preventing accidental actuation of the lock by the lateral impact of an object. The inclination of the flanges also has the effect, in the event of lateral impact, of obtaining a force which tends to press the flanges against the rail.

The rail could have an arbitrarily different profile, for example a profile as represented in the utility model DE 295 20 845.

Instead of holes, the rail could have a rack, for example a rack as represented in the utility model DE 295 20 845. The lock could have holes interacting with teeth or a rack on the rail.

The device according to the invention is, of course, applicable to a binding element for the toe of the boot.

The unlocking lever could be a separate part from the lock, fixed on the lock or articulated to the lock and bearing on the rail.

What is claimed is:

1. A device for holding a boot on a gliding board, comprising a body (1) which is mounted so as to slide on a rail (4), a lock (9) which is articulated to said body and immobilizes said body on a rail, the lock and the rail being provided with mutual attachment means along a central region (4*a*) of the rail, which attachment means comprising teeth (10) and recesses (7) in which the teeth are engaged, the lock being provided with an unlocking lever (20) extending above the rail, said lever being operable to manually release the lock from the rail by the engagement of a finger under the lever, wherein said lever (20) is provided with two lateral flanges (21, 22) extending downward, as far as the rail, on each side of said central region of the rail, said flanges are held laterally by the rail and are located longitudinally at a distance from a point where the lock attaches to the rail, wherein said recesses (7) are formed in the central region (4*a*) which is raised, and the flanges (21, 22) of the unlocking lever bear on the sides of the central region (4*a*) of the rail.

2. The device as claimed in claim 1, wherein the flanges (21, 22) of the unlocking lever are inclined and diverge downward.

3. The device as claimed in claim 1, wherein the rail has two longitudinal grooves placed on each side of the central region, and the flanges of the unlocking lever are parallel with and engaged in said grooves, the grooves have a width which is substantially equal to the flanges of the lock.

4. The device as claimed in claim 1, wherein the flanges are inclined upward in the direction of the point where the lock attaches to the rail.

* * * * *